US006209281B1

(12) United States Patent
Rice

(10) Patent No.: US 6,209,281 B1
(45) Date of Patent: Apr. 3, 2001

(54) BRICK TIE ANCHOR

(75) Inventor: John Rice, Concord (CA)

(73) Assignee: Bailey Metal Products Limited, Concord (CA)

( * ) Notice: Subject to any disclaimer, the term of this patent is extended or adjusted under 35 U.S.C. 154(b) by 0 days.

(21) Appl. No.: 09/213,270

(22) Filed: Dec. 17, 1998

(30) Foreign Application Priority Data

Jan. 30, 1998 (CA) ..... 2228407

(51) Int. Cl.[7] ..... E04B 1/38

(52) U.S. Cl. ..... 52/714; 52/379; 52/562; 52/713

(58) Field of Search ..... 52/714, 489.1, 52/481.2, 379, 773, 383, 713, 410, 508, 562, 555, 568, 565

(56) References Cited

U.S. PATENT DOCUMENTS 4,021,990 * 5/1977 Schwalberg ..... 52/714
4,598,518 * 7/1986 Hohmann ..... 52/410
4,622,796 * 11/1986 Aziz ..... 52/747
4,827,684 * 5/1989 Allan ..... 52/378
4,843,776 * 7/1989 Guignard ..... 52/714
4,955,172 * 9/1990 Pierson ..... 52/710
5,207,043 * 5/1993 McGee ..... 52/379
5,392,581 * 2/1995 Hatzinikolas ..... 52/712
5,440,854 * 8/1995 Hohmann ..... 52/489.1
5,490,366 * 2/1996 Burns ..... 52/713
5,671,578 * 9/1997 Hohmann ..... 52/562
5,720,460 * 2/1998 Watson ..... 52/712
5,755,070 * 5/1998 Hohmann ..... 52/489.1
5,816,008 * 10/1998 Hohmann ..... 52/565
5,893,254 * 4/1999 Troiani ..... 52/169.9

* cited by examiner

*Primary Examiner*—Beth A. Stephan

(57) ABSTRACT

The invention is directed to a masonry anchor for tying a masonry veneer wall to a stud back-up wall having an outer covering, the anchor comprising a generally planar anchor plate having an outer coupling end for connection to a veneer tie wire and an inner anchoring end for securement to the back-up wall. In one embodiment, the anchor plate has struck-out tabs extending laterally from the anchor plate, intermediate the coupling end and the anchoring end. The outer coupling end of the anchor is insertable through a slot opening cut into the outer covering adjacent a stud in the back-up wall until the tabs engage the outer covering of the stud back-up wall to provide for proper spacing of the coupling end from the back-up wall. In a second embodiment of the masonry anchor, at least the outer coupling end is of a corrosion resistant material.

10 Claims, 9 Drawing Sheets

14
26
12
16
50
10
30
36
34
44
32
52
42
40
24
18
20

BRICK TIE ANCHOR

The present invention relates to masonry anchor members for tying a masonry veneer to a stud back-up in a cavity wall and more particularly to the provisions of anchor members which can be quickly installed to project at precisely the right distance from the back-up stud while requiring substantially less material than conventional anchor members, and still more particularly to anchor members as aforesaid which will not be subject to or will have a greatly increased resistance to corrosion.

BACKGROUND OF THE INVENTION

Cavity walls of a masonry veneer tied to a backup wall are commonly utilized in construction to provide for an aesthetically pleasing appearance while being less expensive than solid masonry walls. One common type of cavity wall used in both residential and commercial buildings is a brick veneer tied to a stud back-up wall.

The brick veneer is tied to the stud back-up wall by use of masonry or brick veneer anchors. Such anchors are generally a planar anchor plate which is attached to the stud of the stud back-up wall. The anchor plate at the exposed end is provided with a slot through which a brick tie wire is inserted, the brick tie wire being mortared between two rows of bricks to provide a secure connection between the brick veneer and back-up wall. As there are a large quanitty of connectors required to secure the brick veneer their cost becomes a very critical factor. In the past, these connectors have been made of a galvanized carbon steel which is a material similar to that which is used in the construction of the metal studs for the stud back-up walls.

While it is highly desirable to provide for the proper location of the anchor plates so that the slotted exposed ends stand at the correct distance proud of the back-up wall, the commonly utilized means for effecting such location has necessitated added plate material increasing costs. As a result some anchor plates have eliminated any locating means and have to be set in position simply by sight giving rise to inaccurate tie wire embeddments. In addition, there has recently been serious concern expressed by a number of agencies regarding the potential for corrosion and failure of the masonry anchors due to the exposure of the anchors to moisture which is present in the cavity between the stud back-up wall and the masonry veneer.

One widely used example of a connector which provides for accurate presentation of the slotted exposed end of the anchor plate is an L-shaped connector plate with the base of the "L" fitting over the face edge of the stud and the leg of the "L" being connected to the main part of the stud and having a slot for a brick tie wire in a nose portion of the plate extending beyond the front edge of the stud. By constructing the anchor in such a shape, various sizes of anchors for various sizes of studs, such as "4", "6" and "8" inch studs, may be constructed. While such an anchor plate is hugely successful, it requires a significant quantity of material which increases with stud size giving rise to increasing costs.

SUMMARY OF THE INVENTION

The present invention in one aspect provides for an anchor member for an anchor tie for tying courses of masonry veneer to a backup wall of sheet material supported by spaced vertical studs which anchor members can be easily installed to project at precisely the right distance from the back-up wall while requiring substantially less material than conventioanl anchor members.

In another aspect, the invention provides for an anchor plate as aforesaid which utilizing the reduced material requirement of the invention augment by the increased strength of stainless steel adding to the size reduction, can be economically made of stainless steel to compete with conventional anchors having locating means thereby eliminating the problems of anchor plate corrosion.

More particularly, the anchor plate or member of the invention, which to take full advantage of the invention is formed of stainless steel, has a nose portion adapted to be projected through a vertical slit in a backup wall sheet material, and an anchor portion to extend rearwardly of the sheet material and to be secured to a stud supporting the sheet material.

The nose portion of the anchor plate which has a tie wire slot formed therein, has a maximum vertical dimension for maximum adjustability such that the length of the tie wire slot is not greater than approximately the height of a veneer course. The horizontal dimension of the nose portion is sufficient to present the tie wire slot standing proud of the backup wall sheet material at precisely the desired distance when the anchor plate is installed.

The anchor portion of the anchor plate has a maximum horizontal dimension not greater than approximately one-half of the width of the smallest studs usually encountered in back-up walls. The anchor portion of the plate is provided with a locating abutment means projecting perpendicular thereto to engage a backup wall surface to fix the projection of said anchor nose portion beyond the backup wall sheet material at precisely the desired distance.

In another aspect, in a preferred form the present invention provides for an anchor member comprising a generally planar anchor plate having an outer coupling nose or end for connection to a veneer tie wire and an inner anchoring portion or end for securement to the back-up wall. The anchor plate has struck-out tabs extending laterally thereof intermediate the coupling end and the anchoring end. The outer coupling end is insertable through a slot cut through the back-up wall insulating sheet material adjacent a supporting stud until the tabs engage the inner face of the sheet material to provide for proper spacing of the coupling end from the back-up wall.

In still another aspect, the invention provides for a tool engaging ledge arrangement struck out from the anchoring end of the anchor plate whereby the plate can be held with a tool such as a screwdriver inserted beneath the ledge arrangement when it is being fastened to a stud.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
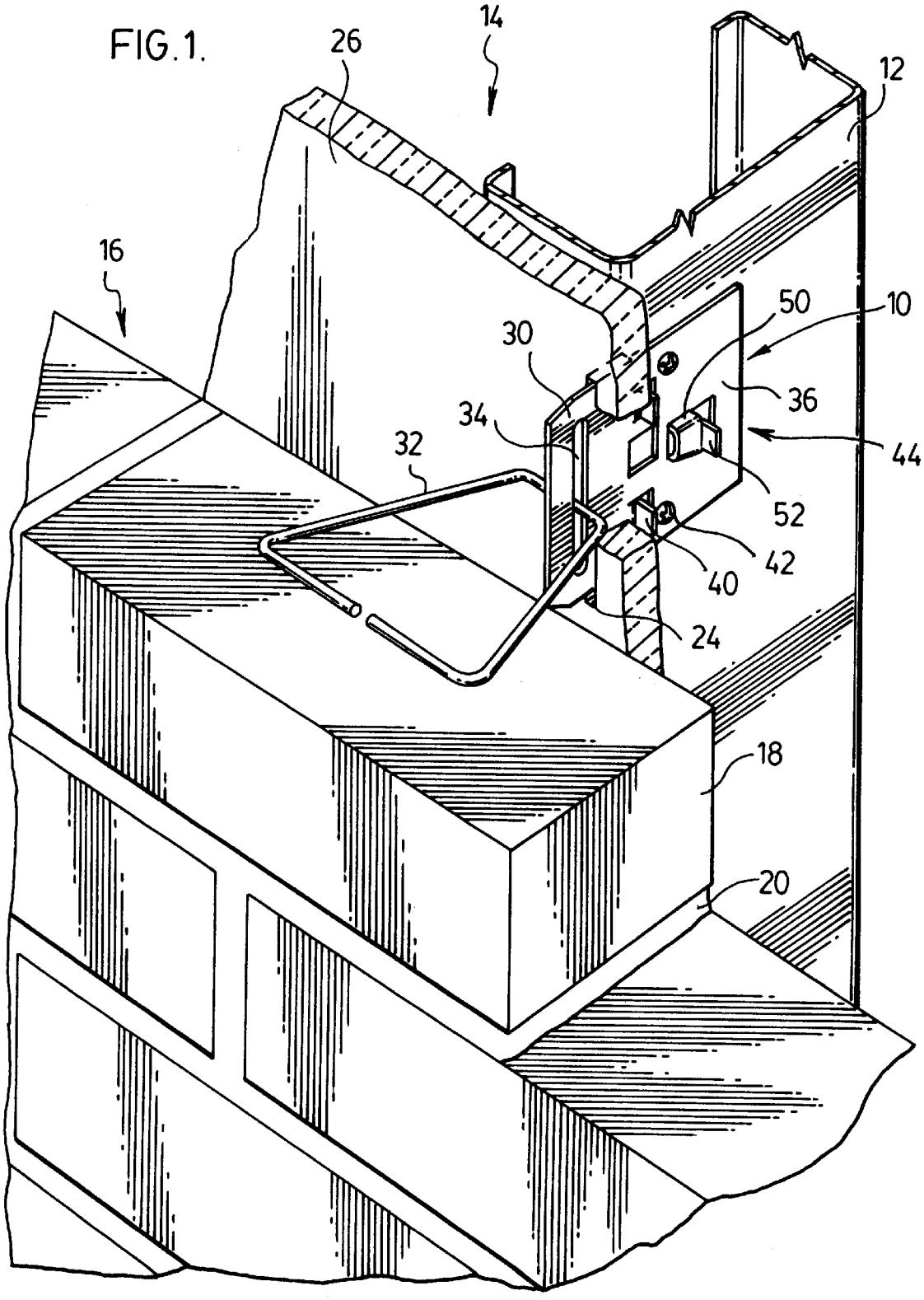
FIG. 1 is a perspective view, partly in cross-section of a first embodiment of a brick veneer anchor of the present invention.

The present invention in one aspect is directed to a masonry anchor member or plate and, in particular, to a brick veneer anchor plate for use in tying a brick veneer wall to a stud back-up wall. According to this aspect of the invention, the anchor plate required a minimum amount of material for cost savings while at the same time incorporating means for easily installing same to project at precisely the correct distance forwardly of the back-up wall.

In another aspect the present invention is directed to an anchor member or plate as aforesaid which will eliminate the problem of corrosion presently experienced by the exposure of the anchor member to the environment of the moisture collecting cavity between the brick veneer and the back-up wall.

In still another aspect of the invention, as a consequence of reducing the size of the anchor, it has also been found desirable to provide for ways and means for easy installation of the anchor to the stud of the back-up wall. This has been accomplished in preferred embodiments of the invention with the use of holding means adapted for holding the anchor in position while allowing the installer to attach the anchor to the stud of the stud back-up wall.

According to the preferred form of the invention the utilization of the principal of anchor size reduction is coupled with the use of stainless steel as the material of the anchor plate. The use of stainless steel gives the desired corrosion resistance while at the same time its increased strength over the standard galvanized steel enables the additional reduction in anchor size without loss of tie holding power. As a result, the preferred form of this invention has enabled the conventional corrosion susceptible anchors to be replaced by corrosion resistant anchors without added cost, while at the same time enabling such anchors to incorporate means for their accurate installation.

A first preferred embodiment of a masonry anchor according to the present invention is illustrated in FIGS. 1 through 4. The masonry anchor of this embodiment is particularly of use as a brick veneer anchor and is shown in the figures generally indicated by the numeral 10. Brick veneer anchor 10 is attached to a stud 12 of a stud back-up wall 14 to tie a brick veneer wall 16 constructed of a number of courses of individual bricks 18 to the back-up wall 14. Bricks 18 are mortared together by use of mortar 20 to form the brick veneer wall 16. Brick veneer wall 16 is spaced from the stud back-up wall 14 to provide an intermediate air space or cavity 22.

Figure 2:
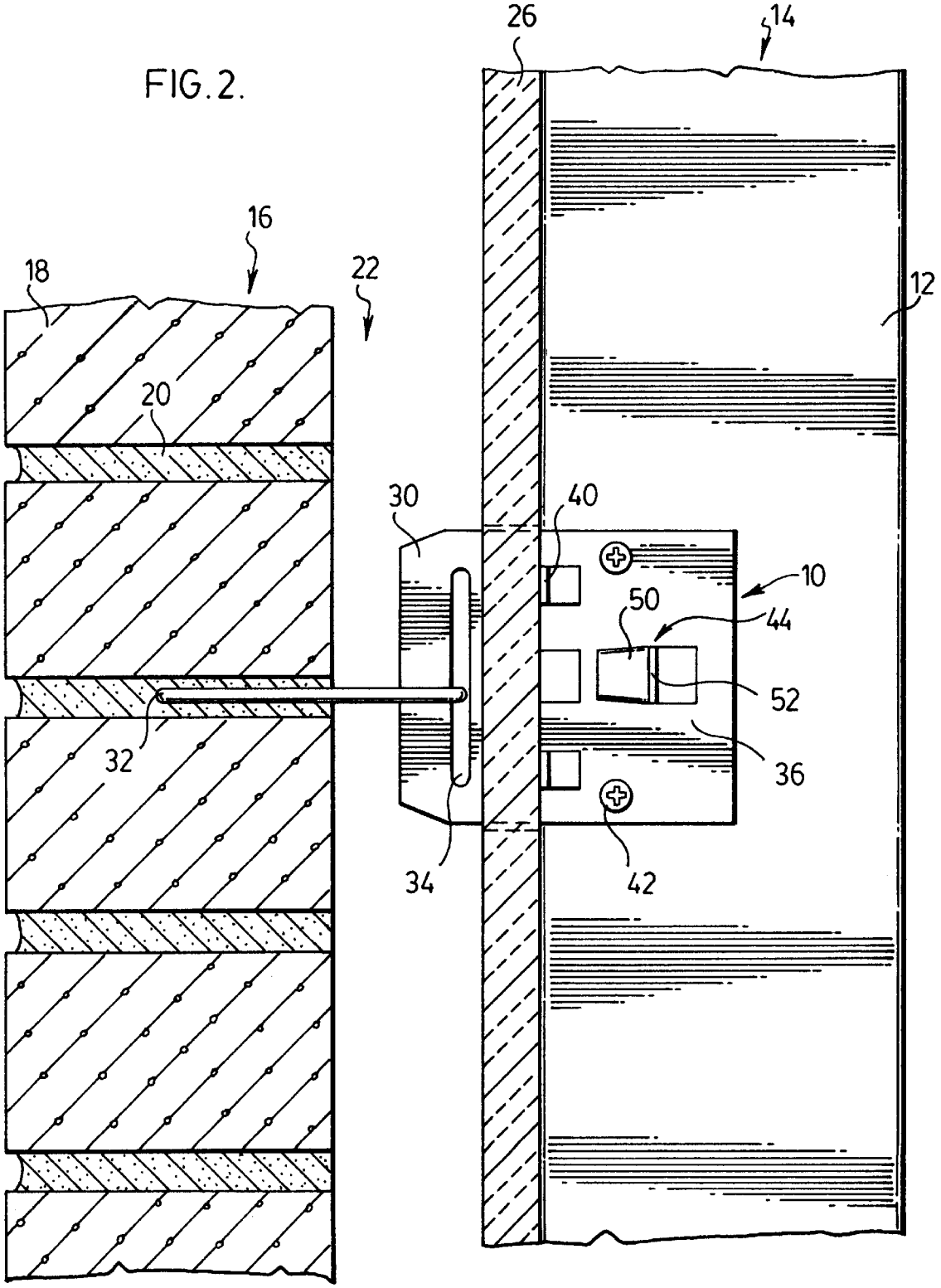
FIG. 2 is a side elevation view of the brick veneer anchor of FIG. 1.
Figure 3:
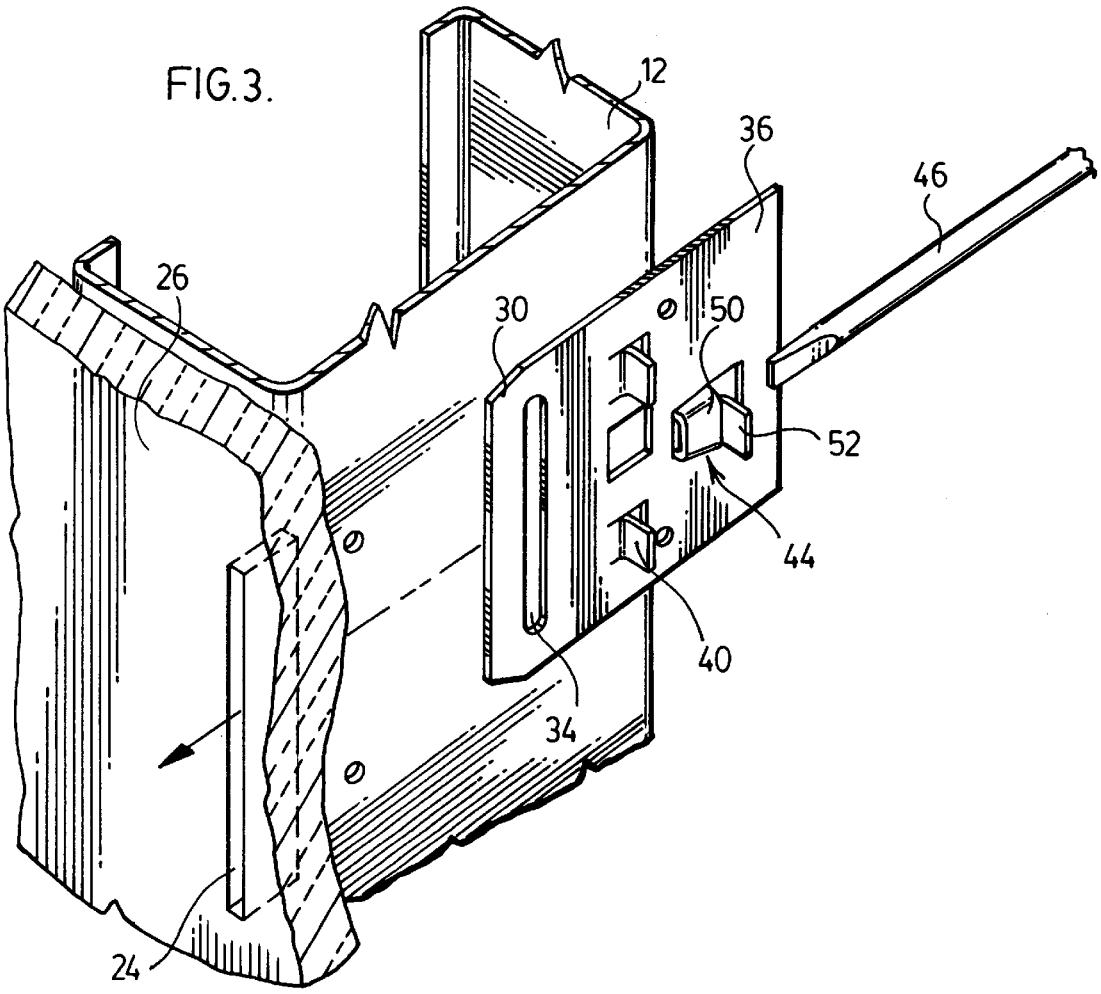
FIG. 3 is a perspective view of the brick veneer anchor of FIG. 1 during installation using a screwdriver to hold the brick tie.

As illustrated in FIGS. 1 and 2, stud wall 14 is comprised of a plurality of studs 12 to which an outer covering 26 is attached. During construction of the stud back-up wall 14 the studs 12 are placed in position and then the outer covering 26 is attached to the studs 12 to form the stud back-up wall 14. A number of slots 24 are cut in the outer covering 26 adjacent the studs 12 to provide for openings through which the brick veneer anchor 10 may be inserted as will be described below.

Brick veneer anchor 10 is comprised of a generally planar body or anchor plate manufactured from stainless steel to resist the corrosion effects of the environment of the cavity 22. Anchor 10 has an outer coupling nose or end 30 having a vertically extending slot 34 for connection to a veneer tie wire 32 and an inner anchoring end 36 for securing the anchor 10 to the stud 12. Outer coupling end 30 has a width sufficient to project the vertically extending slot 34 beyond the outside surface of the back-up stud wall 14. This dimension would depend upon the thickness of any covering 26 attached the the stud back-up wall 14. Generally, the coupling end 30 would project the slot 34 at least 0.5" into the cavity 22 beyond the wall surface. For a wall covering 26 of about 0.5 inch or where there is no wall covering on the stud back up wall 14, the coupling end 30 is generally about 1.5 inches in width and the slot 34 is located about 0.5 inch in from the front edge of the coupling end 30. For wall coverings 26 of about 1.5 to 2 inches, the width of the coupling end 30 would generally be about 3 inches with the slot 34 again located about 0.5 inch in from the front edge of the coupling end 30.

The vertically extending slot 34 has a maximum vertical dimension approximately equal to the height of the brick 18 and has a horizontal dimension to allow the tie wire 32 to pass through. The dimensioning of the vertically extending slot 34 allows for adjustability of the positioning of the tie wire 32 in relation to the anchor 10 to allow for adjustment based on the location of the brick courses of the brick veneer wall 16. Brick tie wire 32 extends from the coupling end 30 to lie between two courses of bricks 18 in the brick veneer wall 16. After the tie wire 32 is properly positioned as shown in FIG. 1, it is mortared between the two courses of bricks 18 of the brick veneer wall 16. In this way, the brick veneer wall 16 is securly tied or connected to the stud back-up wall 14.

It will be considered that the height of the nose portion 30 which accomodates the tie wire slot 34 will depend on the amount of vertical ajustment required to meet variations in the mortaring of the brick veneer. For example, when erecting buildings or shopping malls, the care taken to ensure the eveness of the mortaring is much less than when erecting multiple sotry buildings such as apartment buildings where the spacing between floors is preceise. Thus, for multiple story buildings such as apartment buildings the tie wire adjustments can be less requiring smaller anchors.

As practical expamples for a 3 inch brick course providing for a full course adjustment the height of the nose portion 30 would be of the order of 4 inches and the length of the slot 34 would be of the order of 3 inches.

Where this degree of adjustment is not required the height of the nose piece 30 for example could be 3 inches with the length of the slot 34 being 2¼ inches. Again, as another example, for a nose portion 30 having a height of 2 inches, the length of the slot would preferrably be 1¼ inches.

The brick veneer anchor 10 is provided with an anchoring end distal of the coupling end for securing the anchor 10 to the stud 12 of the stud back-up wall 14. In order to provide for proper positioning of the brick veneer anchor 10 relative to the stud 12 to provide for the proper exposure of the coupling end 30 and the slot 36, the anchor 10 is provided with locating abutment means projecting perpendicular thereto. In the embodiment illustrated, the locating abutment means are struck-out tabs 40 which, when the anchor is inserted through the slot 24 the outer covering 26, rest against the rear surface of the outer covering 26. Once the anchor 10 is in this proper position, it may be attached to the stud 12 of the stud back-up wall 14 by suitable means, such as sheet metal screws 42 for metal studs 12 or wood screws for wood studs.

The brick veneer anchor 10 is relatively small in order to reduce the amount of material used while still providing sufficient area for proper securement to the stud 12. Generally, the horizontal dimension of the anchoring end 36 of the anchor 10 is no more than one half the width of the stud 12. For a "4" inch stud which is actually 3.625 inches in width, the anchoring end 36 is 1.75 inches or less in width, preferrably 1.5 inches in width. For a "6" or "8" inch stud 12, the anchoring end 36 is preferrably 1.75 inches in width.

Figure 4:
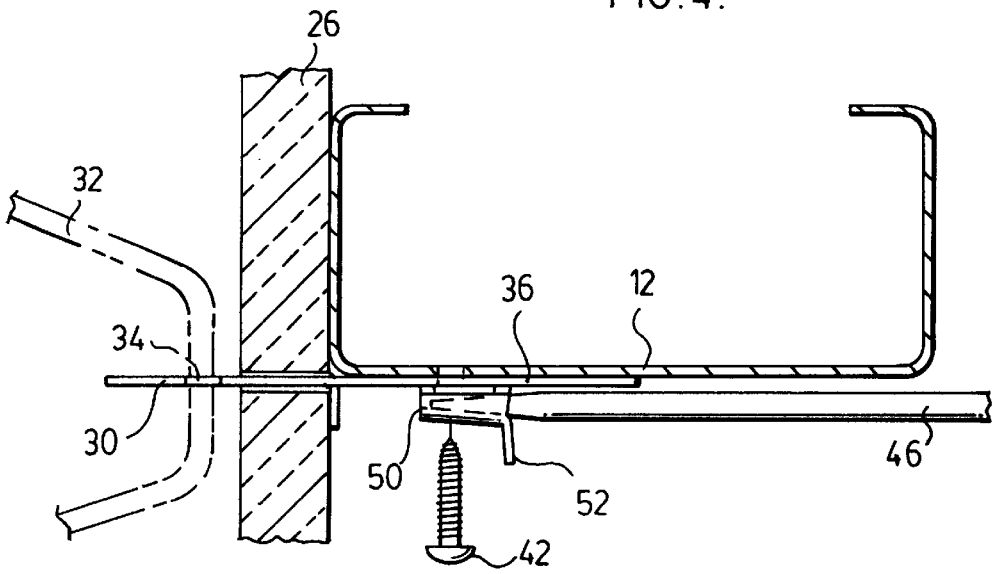
FIG. 4 is a top plan view of the installation of the brick veneer anchor of FIG. 1.

As the anchoring end 36 is relatively small, it could be difficult for the installer to hold the anchor in the proper position and at the same time attach it to the stud 12. In order to make it easier for an installer to hold the anchor 10 in position, the anchor 10 is preferably provided with a holding means 44 for holding the anchor 10. The holding means 44 preferably allows for the anchor to be held in position either by hand or by use of a suitable tool, such as a screw driver or a tool specially adapted for holding of the anchor. In the preferred embodiment of the masonry anchor 10 as illustrated in FIGS. 1 through 4, the holding means 44 is adapted to permit holding of the anchor 10 either by hand or by use of a screwdriver 46 or a specially adapted tool 48. This is accomplished by providing the holding means 44 with a an upstanding ledge formation shown as a strap 50 which is struck out of the planar body of the anchor 10. Ledge formation or strap 50 is spaced laterally from the body of the anchor 10 to provide for a space between the underside thereof and the body of the anchor 10 sized to permit the end of a flat blade screwdriver 46 to be inserted into the opening as illustrated in FIG. 4. This permits the installer to hold the anchor 10 in position using the screwdriver 46 with one hand, and then use the other hand to drive the screws 42 through the anchor 10 and into the stud 12. Preferably, to accommodate the end of the screwdriver 46, strap 50 has a slight wedge or trapezoidal shape with the front having a reduced width relative to the back of the strap 50 and hence the opening between the strap 50 and the body of the anchor 10 is also wedge shaped.

In order to allow the anchor 10 to be held by hand rather than through use of a screwdriver 46 or tool 48, the holding means 44 for holding the anchor 10 is preferably provided with a second part, namely, a struck out tab 52 which extends perpendicular from the back end of the strap 50. This tab 52 allows for griping of the tab 52 by the fingers of the installer so that the installer may hold the anchor in the proper position for insertion of the screws 42 through the anchor 10 and into the stud 12.

Figure 5:
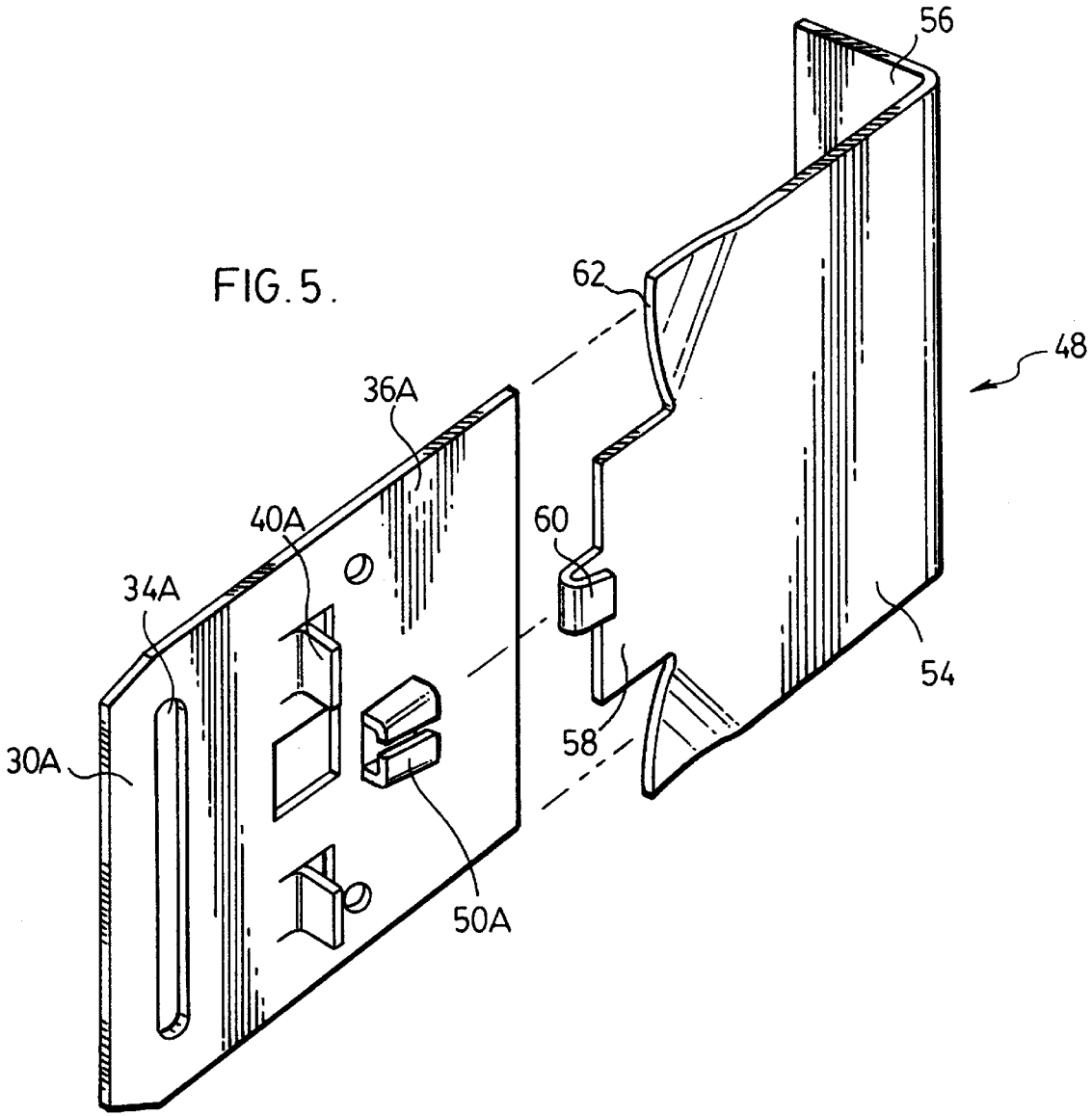
FIG. 5 is a perspective view of a second embodiment of the brick veneer anchor of the present invention and a tool for holding the brick tie during installation.
Figure 6:
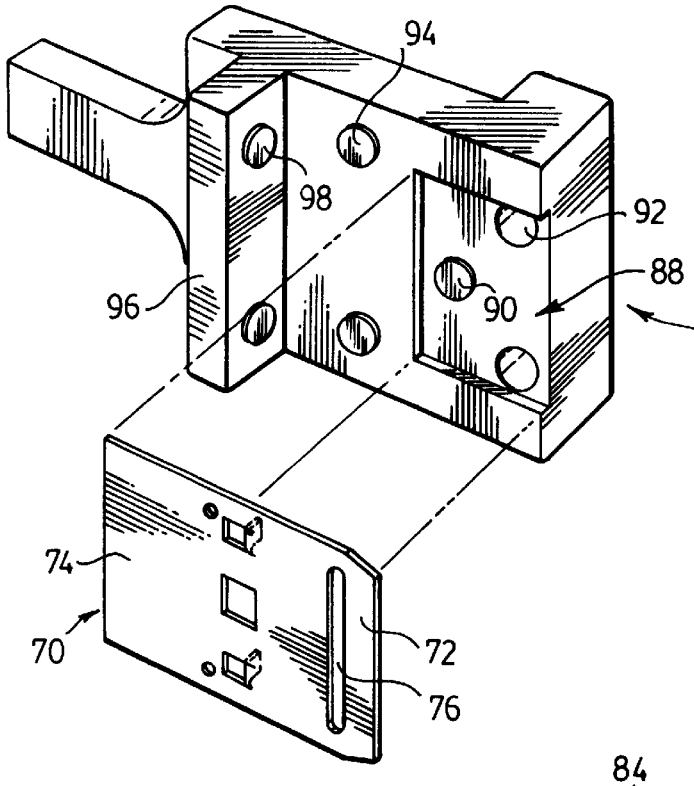
FIG. 6 is a perspective view of a third embodiment of a brick veneer anchor of the present invention and a tool adapted for use in the installation of the brick veneer anchor.
Figure 7:
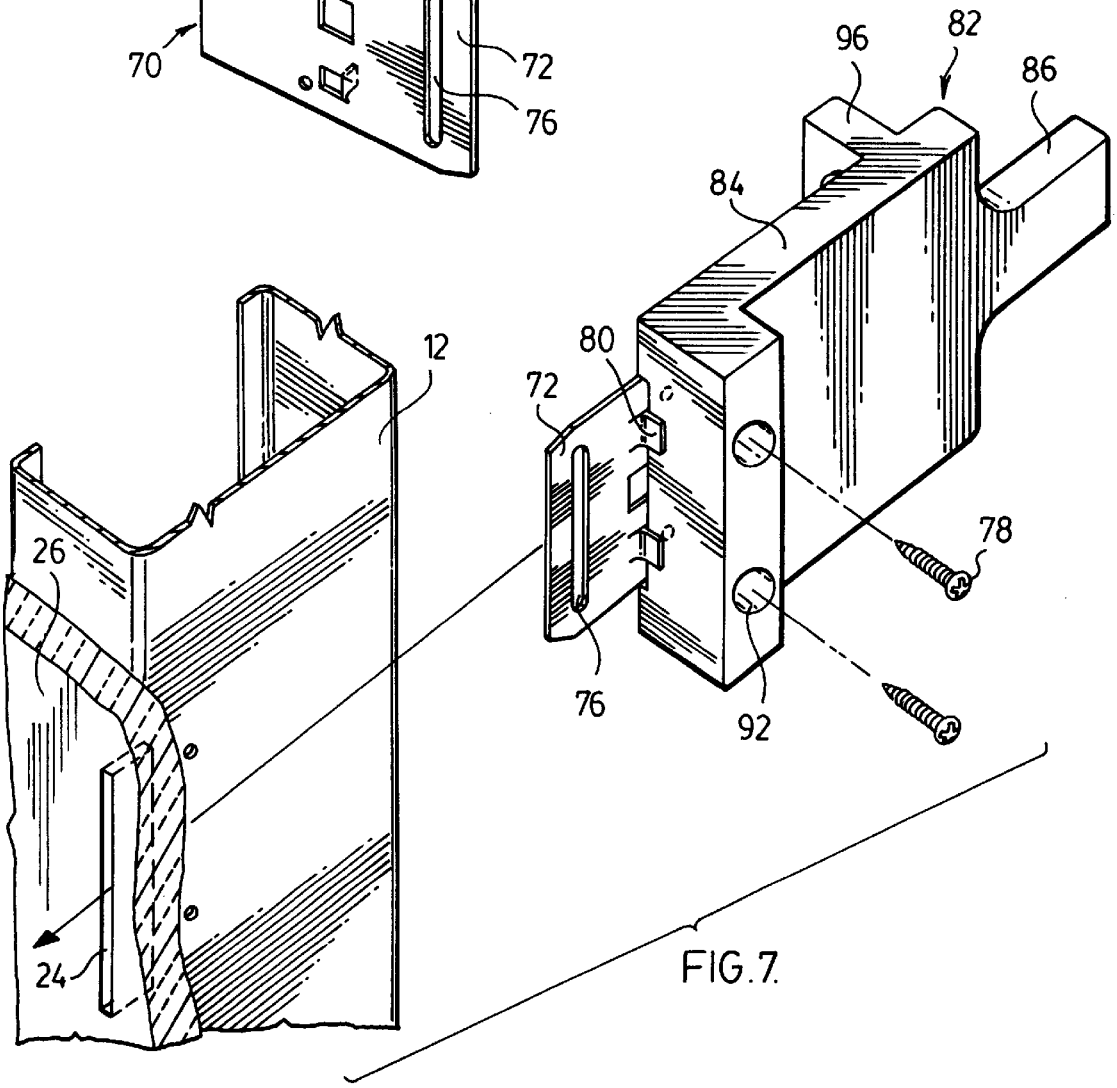
FIG. 7 is perspective view of the brick veneer anchor of FIG. 6 during installation.

FIG. 5 illustrates a second embodiment of a brick veneer anchor of the present invention which is a variation of the first embodiment. Similar to the first embodiment, brick veneer anchor 10A is comprised of a generally planar body or anchor plate constructed of a stainless steel material having an outer coupling end 30A for securing the anchor 10A to a stud 12. Outer coupling end 30A is provided with the vertically extending slot 34*a* dimensioned as in the first embodiment. Anchor 10A is provided with locating enbuttment means namely, struck-out tabs 40*a*, intermediate the outer coupling end 30A and the inner anchoring end 36*a*. Masonry veneer anchor 10A is also provided with holding means for holding the anchor 10A by use of a suitable tool such as a screwdriver or the tool 48 specially adapted for holding the anchor 10A. In contrast to the first embodiment, holding means 44A comprises a split strap 50A. This construction of the strap 50A is particularly suitable for use with material which is less malleable and which may not have the properties to permit for the strap and holding tab to be struck out, similar to the first embodiment. Split strap 50A is formed by first making an H-shaped cut within the body of the anchor 30A. The two tabs formed by the H-shaped cut are then pushed out to form the split strap 50A. FIG. 5 illustrates the use of the special tool 48 adapted to allow for proper positioning of the anchor 10A for attachment to the stud or the stud back-up wall. This tool 48 is also usable with the first embodiment of the masonry anchor 10 illustrated in FIGS. 1 to 4.

As illustrated in FIG. 5, the tool 48 has a first generally planar portion 54 with a second portion 56 attached to the rear edge of the first portion 54 generally perpendicular to the first portion 54 to form a generally L-shaped tool. The dimension of the first portion 54 is selected such that when the tool 48 is attached to the anchor 10 or 10A, the dimension between the tabs 40 or 40A of the anchor 10 or 10A and the second portion 56 is the same as the depth of the stud 12 of the back-up wall 14. Thus, tools adapted for different sizes of studs, such as "4", "6" or "8" inch studs, may be provided. The forward edge of the tool 48 is provided with a centrally extending tongue 58 which has a means 60 for engaging with the holding means 44 or 44A by insertion into the spacing or gap between the strap 50 or 50A and the body of the anchor 10 or 10A. The front edge of the tool 48 on either side of the forwardly extending tongue 58 is provided with shoulders 62 which are displaced slightly out of the plane of the first portion 54 to allow the shoulders 62 to engage with the rearward edge of the anchor 10 or 10A when the tool is releasably attached to the anchor 10 or 10A. In order to allow for almost hands free installation of an anchor 10 or 10A constructed of hot dip galvanized steel using the tool 48, the tool 48 may be provided with magnetized regions which can be utilized to releasably hold the anchor 10 or 10A to the tool 48, as well as releaseably hold the tool 48 to a metal stud 12 if the anchor 10 or 10A is being installed on a metal stud back-up wall 14. Thus, magnetized regions may be provided on the interior face of the forwardly extending tongue 58 to releasably hold a hot dip galvanized anchor 10 or 10A to the tool 48 as well as on the interior face of the second portion 56 or the first portion 54 to releaseably hold the tool 48 and its attached anchor 10 or 10A to a metal stud 12. Anchors 10 or 10A constructed of stainless steel are generally non-metallic. In these circumstances, the shoulder 62 of the tool 48 may be provided with a gripping means to grip the anchor 10 or 10A so that it may be properly held by the tool 48. Alternatively, the means 60 for engaging with the holding means 44 or 48A may be dimensioned to provide for a tight friction fit between the holding means 44 or 44A and means 60 on the tool. Once the anchor 10 or 10A has been attached to the metal stud 12, the tool 48 is easily removed from the anchor 10 or 10A by breaking the magnetic contact. By utilizing the magnetized regions to hold the anchor 10 or 10A and tool 48 in position the installer has both hands free to properly attach the anchor 10 or 10A to the stud 12 and it is not necessary for them to hold the anchor 10 or 10A in position for attachment to the stud 12. Thus, the installer could hold a screw gun in one hand and could use the second hand for placing the screw 42 in the proper position or for withdrawing screws 42 from a pouch or holder.

A third embodiment of a masonry anchor according to the present invention is shown in FIGS. 6 through 9 generally indicated by the numeral 70. Similar to the first embodiment, masonry anchor 70 is comprised of a generally planar body or anchor plate constructed of stainless steel or other corrosion resistant material having an outer coupling end 72 for connection to a veneer wire tie 32 and an inner anchoring end 74 for securing the anchor 70 to a stud 12. Outer coupling end 72 is dimensioned to project beyond the front surface of the back up wall 14 and is provided with a vertically extending slot 76, dimensioned to allow the wire tie 32 to pass through, and to provide for the adjustability of the positioning of the wire tie 32 relative to the brick courses 18 in the brick veneer wall 16.

Similar to the first embodiment, anchor 70 is attached to a stud 12 of a the stud back-up wall 14 by use of suitable screws 78. Anchor 70 is provided with locating abutment means, namely, struckout tabs 80, intermediate the outer coupling end 72 and inner anchoring end 74 to butt against the outer covering 24 of the stud back-up wall 14 to properly position the anchor 70 so that the outer coupling end 72 is properly exposed beyond the covering wall 24 for insertion of the wire tie 32. In contrast to the first and second embodiments, third embodiment of the anchor 70 is not provided with any means for easily holding the anchor 70. Rather, the anchor 70 utilizes a special tool 82 which holds the anchor 70 in position against the stud 12 for easy attachment of the anchor 70 to the stud 12 by use of screws 78.

In the preferred embodiment illustrated in the figures, tool 82 has a generally paddle shaped body 84 having a handle 86 for griping in the hand of the installer. The interior base of the paddle shaped body 84 is provided with a recessed or cut out region 88 dimensioned to accept the body of the anchor. Preferably in order to releaseably hold the body of a hot dipped galvanized anchor 70 within the recessed or cut out region 88, the recessed or cut out region 88 is provided with one or more magnetized areas 90 which magnetically hold the body of the anchor 70 within the recessed or cutout region 88. Thus, the anchor 70 may be placed within the recessed or cut out region 88 and then the installer utilizes the tool 82 to which the anchor 70 is attached to insert the outer coupling end 72 of the anchor 70 through the slot 26 in the wall 14. For use with an anchor 70 of non-magnetic stainless steel, the edges of the recessed or cut-out region 88 may be provided with gripping means to releaseably grip the edges of the anchor 70. Once the anchor has been installed to the wall, the tool may easily be removed, releasing the anchor 70 from the gripping means. Another way of holding the anchor 70 to the tool 82, when the anchor is constructed of stainless steel, would be to provide on the front face of the tool a strap or other means for holding the struck-out tab 80 to the front face of the tool. The tool 82 is provided with holes 92 which line up with the holes 70 for the screws. These holes 92 thereby provide guides for the installer to utilize the screws 78 to attach the anchor 70 to the stud 12. Once the anchor 70 has been attached to the stud 12, the magnetic contacts of the magnetized region 90 of the anchor 70 or the releaseable connection by the gripping means are broken to thereby release the tool 82 from its attachment to the anchor 70.

In order to permit hands-free installation of the anchor 70 in a proper position for attachment to the stud 12, the inner base of the paddle shaped body 84 may be provided with additional magnetized regions 94 which will magnetically couple the tool 82 and the attached anchor 70 to the stud 12. To increase the magnetic coupling of the tool 82 to the stud 12, the paddle shaped body 84 is preferably provided with a perpendicular extension 96 extending from the interior of the body 84 to provide for an L-shaped interior portion which matches the dimension of the stud 12. Perpendicular extension 96 may also be provided with suitable magnetic regions 98 to increase the releaseable attachment of the tool 82 and the anchor 70 to the stud 12.

While different sizes of tools 82 may be provided for different sizes of studs, such as "4", "6" or "8" inch studs, it is also possible to provide for a tool 84 which is adjustable for use with different size studs. The connection between the perpendicular extension and the paddle shaped body 84 may be provided as a slideable connection to allow for the perpendicular extension 96 to be moved to vary the dimension of the L-shaped interior portion. In this way, the tool is easily adapted for use of different sizes of studs.

Figure 8:
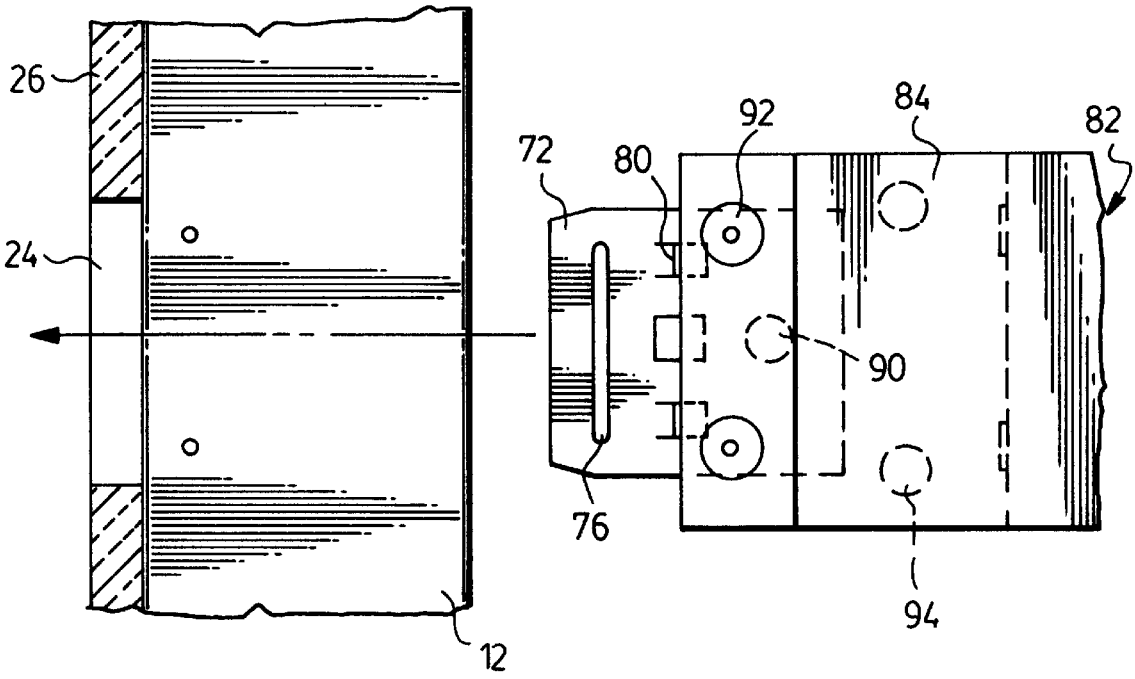
FIG. 8 is a side elevation view of the installation of the brick veneer anchor of FIG. 6.
Figure 9:
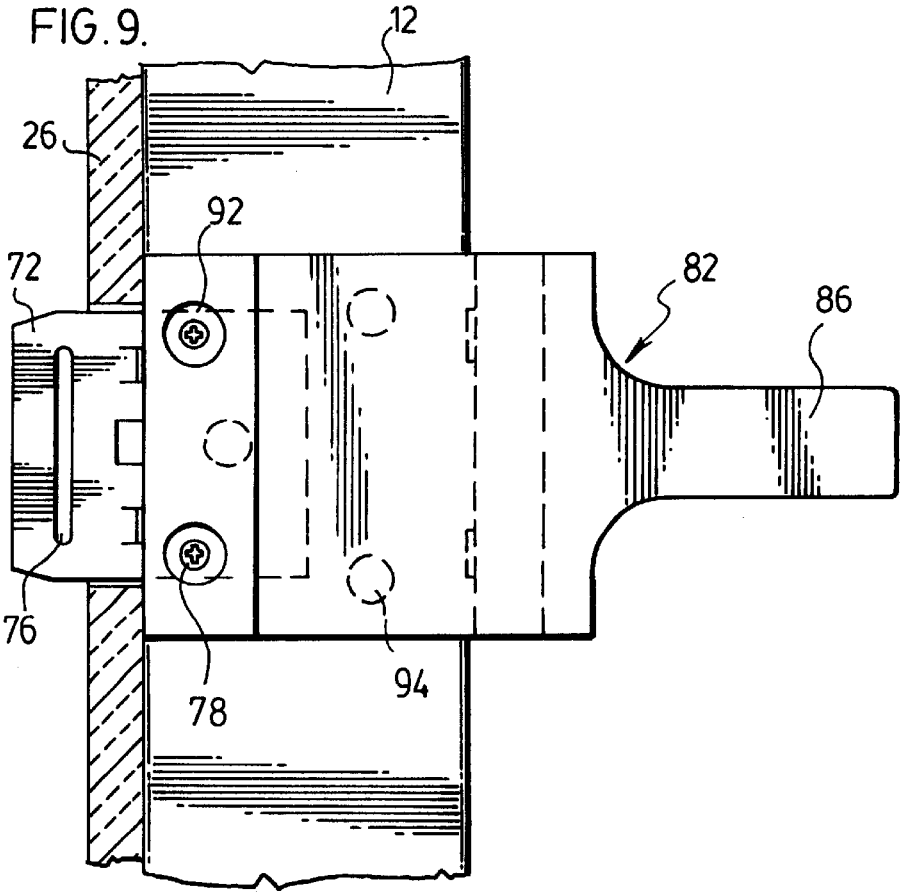
FIG. 9 is a side elevation view of the brick veneer anchor of FIG. 6 showing the attachment of the anchor to a stud.

The installation of this embodiment of a masonry anchor 70 is illustrated in FIGS. 6 through 9. The anchor 70 is initally releasably attached to the recessed opening 88 of the tool 82 by means of the magnetic regions 90 or gripping means. As shown in FIG. 8, the tool 82 and the attached anchor 70 are then slid forward to insert the outer coupling end 72 of the anchor 70 through the slot or opening 26 in the outer covering 24 of the stud back-up wall 14. Once the anchor 70 and tool 82 are in the proper position, screws 78 are inserted through the openings 92 to attach the anchor 70 to the stud 12. The tool 82 may then be removed from the anchor 70 by breaking the magnetic contacts between the tool 82 and the anchor 70 and the stud 12.

The embodiment of the brick veneer anchor 70 illustrated in FIGS. 6 through 9 is also easily adaptable for use in those rare circumstances when the anchor 70 is being installed on a stud back-up wall 12 which does not have an outer cover. In these circumstances, the anchor 70 is flipped over so that the locating abuttment means and the struck-out tabs 80 butt against the outer edge of the stud 12. In these circumstances, the anchor may be easily held in place, either by hand, or by use of the tool. The second embodiment of the anchor as illustrated in FIG. 5 may also be easily adapted for use in stud back-up walls without an outer covering. In those circumstances, the installer could easily hammer down the split strap 50A to flatten it to the plane of the anchor and then flip over the anchor so that the struck-out tabs 40A would abutt the forward edge of the stud 12.

Figure 10:
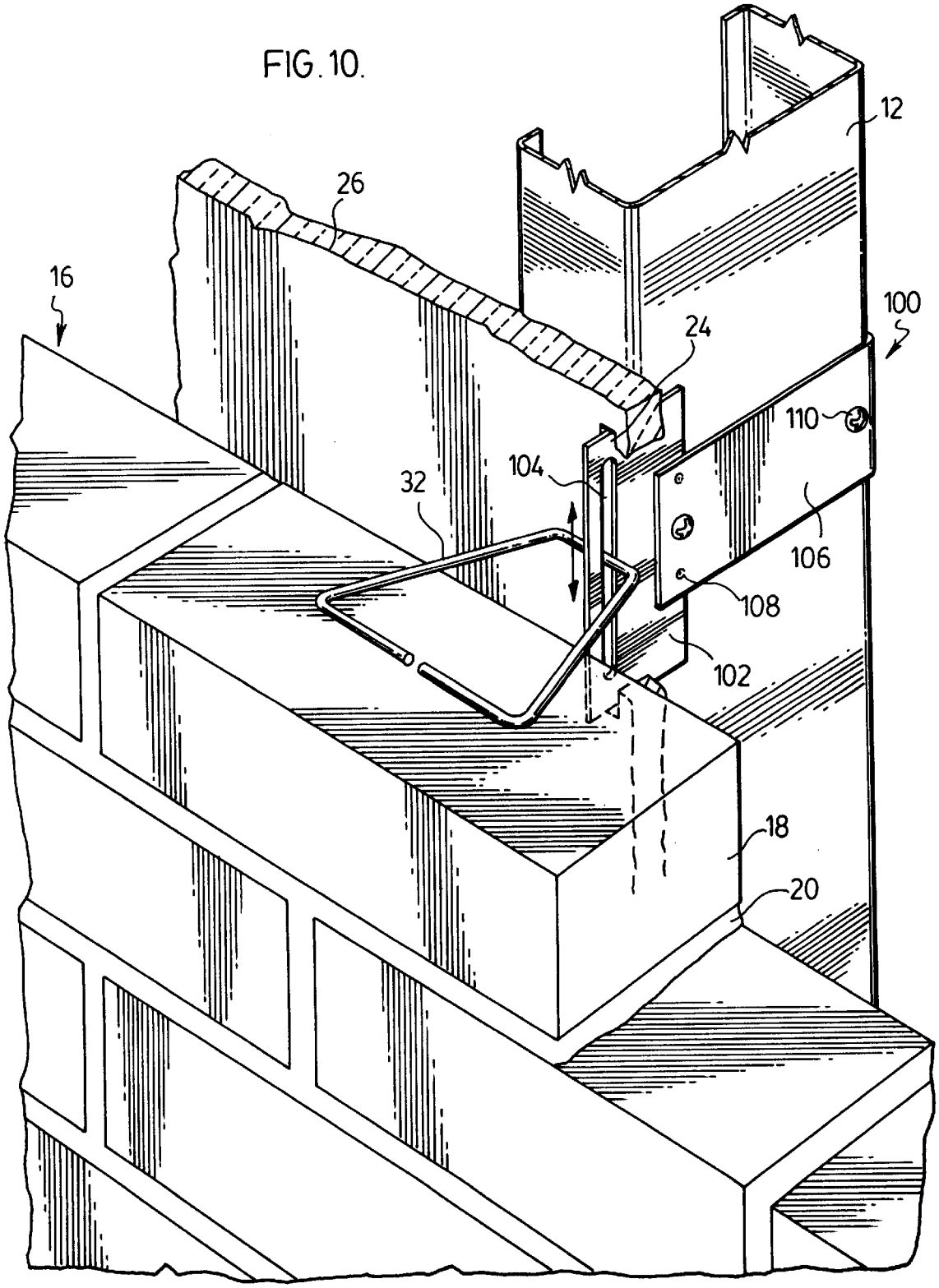
FIG. 10 is a perspective view of a fourth embodiment of a brick veneer anchor of the present invention.
Figure 11:
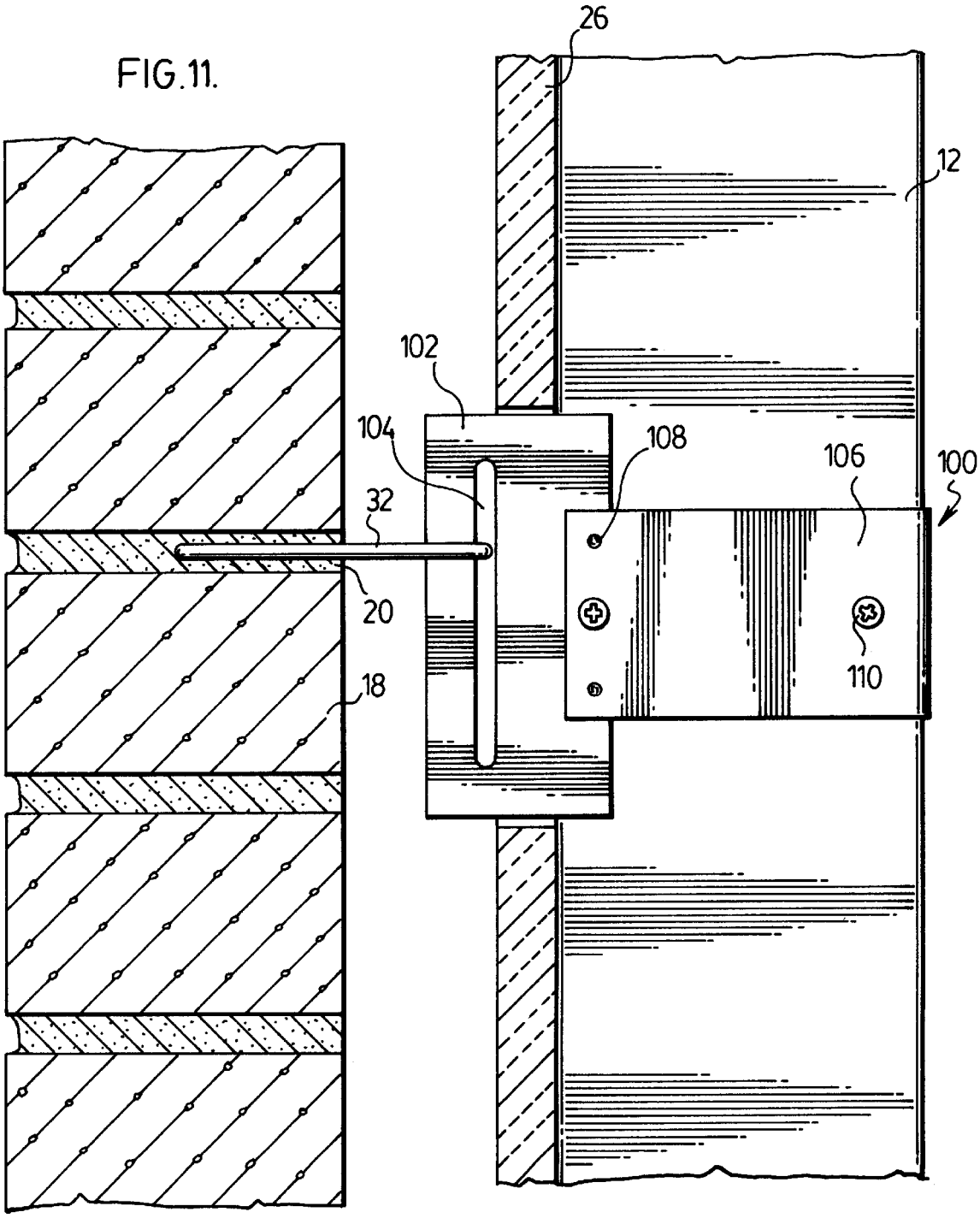
FIG. 11 is a side elevation view of the brick veneer anchor of FIG. 10.
Figure 12:
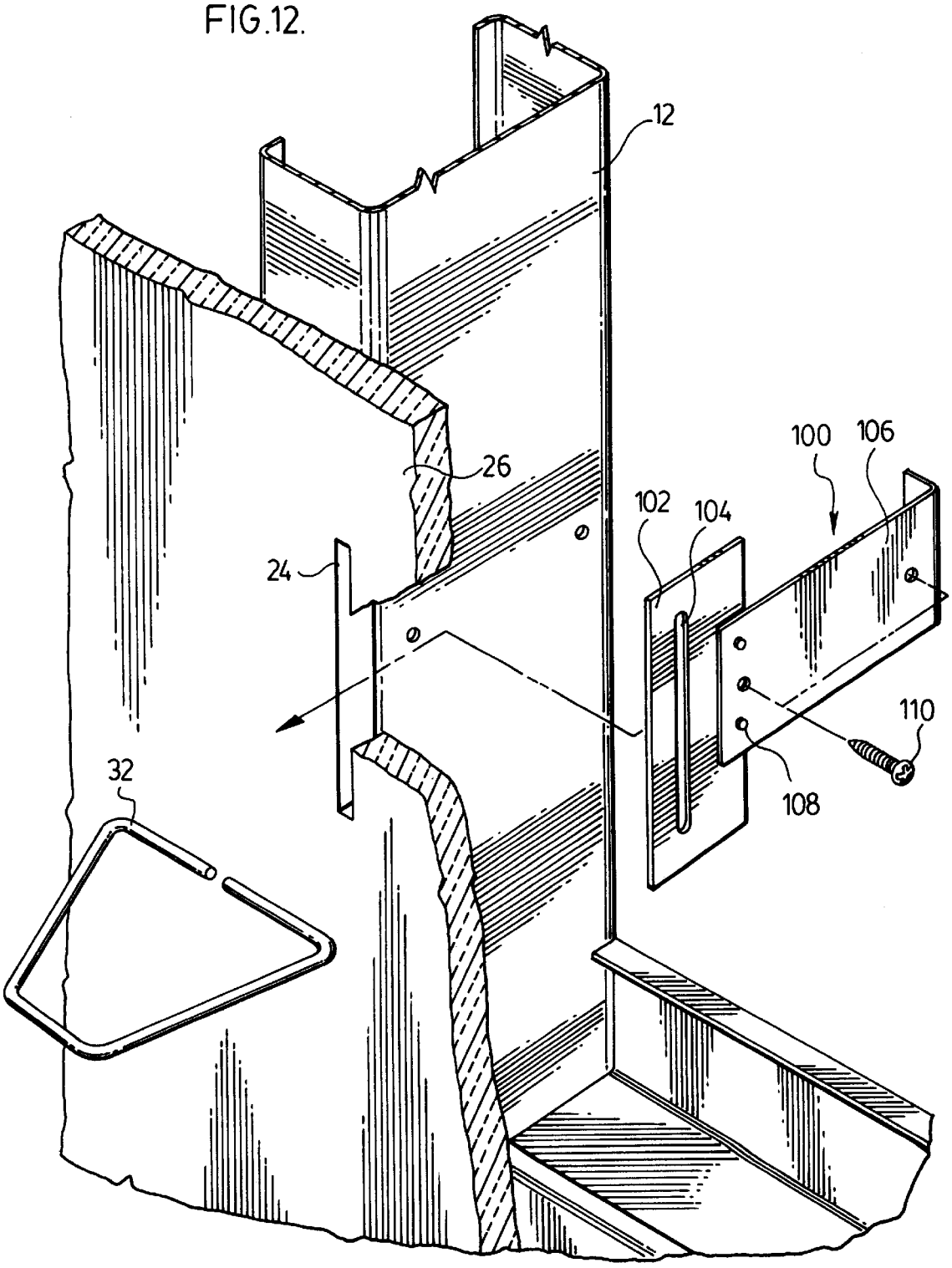
FIG. 12 is a perspective view of the brick veneer anchor of FIG. 10 in the process of being installed.

A fourth embodiment of a masonry anchor according to the present invention is illustrated in FIGS. 10 through 12, generally indicated by the numeral 100. This anchor 100 is a two-part anchor having a forward part 102 which contains the outer coupling region with the associated slot 104 for engagement of the wire tie. This forward part 102, being the part of the anchor 100 which is exposed to the cavity 22 and the moisture contained in the cavity, is constructed of a material having increased resistence to the corrosive effects of the moisture encountered within the cavity 22. Such a material is typically a stainless steel or other corrosive resistant material. The rear part 106 being contained within the stud back-up wall 14 and not being exposed to the moisture may be constructed of a less expensive material, such as a carbon steel. The two parts 104 and 106 are connected to one another by suitable means, such as for example, metal stitching 108. Anchor 100 is also provided with the locating abutment means for properly fixing the projection of the coupling end beyond the front surface of the back up wall 14. In the embodiment illustrated, the second part 106 has a generally L-shaped dimension to correspond to the depth of the stud 12 to act as the locating abutment means. To install the anchor 100, the coupling end is inserted through the slit in the covering 26 of the back up wall 14 and the anchor 100 pushed forward until the leg of the L shaped second part 106 encounters the outer edge of the stud. As the second portion 106 fits easily around the stud, it is a simple matter to hold the anchor 100 in position and insert the suitable screws 110 into the anchor as is shown in FIG. 12. The tie wire 32 is then connected to the outer coupling 102 end in this manner during the laying of the brick courses of the brick veneer wall.

The present invention provides for a masonry anchor, and in particular, a brick veneer anchor for tying a brick veneer wall to a stud back-up wall. The anchor has increased resistance to the corrosive effects of the environment contained within the cavity wall, while at the same time being economical to manufacture and relatively easy to install. The use of the anchor of the present invention provides for an increased life of the anchor in that the moisture which is contained within the cavity will not adversely effect the integrity and strength of the anchor through corrosion.

Although various preferred embodiments of the present invention have been described herein in detail, it will be appreciated by those skilled in the art, that variations may be made thereto without departing from the spirit of the invention or the scope of the appended claims.

What is claimed is:

1. An anchor member for an anchor tie for tying courses of masonry veneer to a backup wall of sheet material supported by spaced vertical studs, said anchor member comprising a plate having a nose portion adapted to be projected through a vertical slit in the backup wall sheet material, and an anchor portion to extend rearwardly of the sheet material and to be secured to the stud supporting the sheet material, said nose portion having a vertical tie wire receiving slot therein, said tie wire receiving slot having a height not greater than the height of a veneer course, said nose portion having a horizontal dimension sufficient to present said vertical slot beyond the backup wall sheet material, and said anchor portion having a horizontal dimension not greater than approximately one-half of the width of the stud supporting the backup wall sheet, said anchor portion of said plate being provided with a locating abutment means projecting perpendicular thereto to engage a backup wall surface to fix the projection of said anchor end beyond the backup wall sheet material said abutment means comprising tab members stamped out from said plate adapted to engage an inner face of the backup wall sheet material.

2. An anchor member as claimed in claim 1 in which said plate is hot dip galvanized steel.

3. An anchor member as claimed in claim 1 in which said plate is stainless steel.

4. A masonry anchor for tying a masonry veneer wall to a stud back-up wall having an outer covering, the anchor comprising a generally planar anchor plate of corrosion resistant steel, said anchor plate having an outer coupling end for connection to a veneer tie wire and an inner anchoring end for securement to the back-up wall, the inner anchoring end having a horizontal dimension not greater than approximately one-half of the width of a stud forming the stud back-up wall, the anchor plate having struck-out tabs extending laterally from the anchor plate, the struck out tabs being intermediate the coupling end and the anchoring end, the outer coupling end being insertable through a slot opening cut into the outer covering adjacent a stud in the back-up wall until the tabs engage the outer covering of the stud back-up wall to provide for proper spacing of the coupling end from the back-up wall.

5. A masonry anchor as claimed in claim 4 wherein the corrosion resistant steel is hot dip galvanized steel.

6. A masonry anchor as claimed in claim 4 wherein the corrosion resistant steel is stainless steel.

7. A masonry anchor as claimed in claim 4 wherein the anchoring end is provided with a holding means for holding of the anchor during installation.

8. A masonry anchor as claimed in claim 7 wherein a hand or a tool may be used to hold the holding means.

9. A masonry anchor as claimed in claim 8 wherein the holding means comprises a ledge formation struck out from said anchoring end and overlying the plane of the anchoring end to accommodate a suitable tool to be inserted into the space between said ledge formation and the plane of the anchoring end.

10. A masonry anchor as claimed in claim 7 in which said holding means comprises a tab formed from the material of said anchoring end and extending generally perpendicular thereto to be gripped by a hand.

* * * * *